US009789934B1

(12) United States Patent
Maresh

(10) Patent No.: US 9,789,934 B1
(45) Date of Patent: Oct. 17, 2017

(54) FLOATATION DEVICE HAVING BUOYANT TILT YAW CONTROL

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 15/075,089

(22) Filed: Mar. 18, 2016

Related U.S. Application Data

(60) Provisional application No. 62/177,563, filed on Mar. 18, 2015.

(51) Int. Cl.

| | |
|---|---|
| ***B63B 35/81*** | (2006.01) |
| ***A63C 5/03*** | (2006.01) |
| ***B63B 35/79*** | (2006.01) |
| ***B63B 35/71*** | (2006.01) |

(52) U.S. Cl.
CPC ..... *B63B 35/7926* (2013.01); *B63B 35/71* (2013.01); *B63B 2035/715* (2013.01)

(58) Field of Classification Search
CPC ..... B63B 35/71; B63B 35/73; B63B 35/79; B63B 35/7916; B63B 35/7926; B63B 2035/71; B63B 2035/715; B63B 2035/73; B63B 2035/79
USPC ..... 441/65, 74
See application file for complete search history.

(56) References Cited

U.S. PATENT DOCUMENTS

| | | | | |
|---|---|---|---|---|
| 5,192,235 | A * | 3/1993 | Dunham | B63H 20/02 248/638 |
| 2012/0216735 | A1* | 8/2012 | Bailey | B63B 35/74 114/55.55 |
| 2013/0328280 | A1* | 12/2013 | Meyer | B63B 35/795 280/87.042 |

* cited by examiner

*Primary Examiner* — Daniel V Venne
(74) *Attorney, Agent, or Firm* — Nick A Nichols, Jr.

(57) ABSTRACT

A floatation device may include a bow section and a tail section pivotally connected to the bow section by a kingpin assembly. The kingpin assembly may be configured to include a positive kingpin inclination angle or a negative inclination angle that determine the yaw direction of the floatation device. A user may control the tilt or roll of the floatation device to offset a yaw direction and maintain a straight line tracking course.

6 Claims, 5 Drawing Sheets

FLOATATION DEVICE HAVING BUOYANT TILT YAW CONTROL

CROSS-REFERENCE TO RELATED APPLICATION

This application claims the benefit of U.S. Provisional Application Ser. No. 62/177,563, filed Mar. 18, 2015, which application is incorporated herein in its entirety by reference.

BACKGROUND

The present invention relates to floatation devices, in particular to a system for a user to effect yaw or rudder control of a floatation device.

Floatation devices, such as standup paddle boards, wake boards, kayaks, surfboards and the like generally require a user to alternatively paddle on the right and left sides of the floatation device to maintain generally straight line tracking. For example, a user on a typical paddle board must alternatively paddle several strokes on the right side of the board, followed by paddling several strokes on the left side of the board in order to maintain straight line tracking. This is because during the act of paddling, a steering moment may be exerted about the center of buoyancy of the floatation device causing it to yaw in a direction that is opposite the side where paddling is occurring. Consequently, users of prior art boards and the like switch paddling sides at given intervals in order to maintain generally straight line tracking.

SUMMARY

A floatation device may include a bow section and a tail section pivotally connected to the bow section by a kingpin assembly. The kingpin assembly may be configured to include a positive kingpin inclination angle or a negative inclination angle that determine the yaw direction of the floatation device. A user may control the tilt or roll of the floatation device to offset a yaw direction and maintain a straight line tracking course.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1:
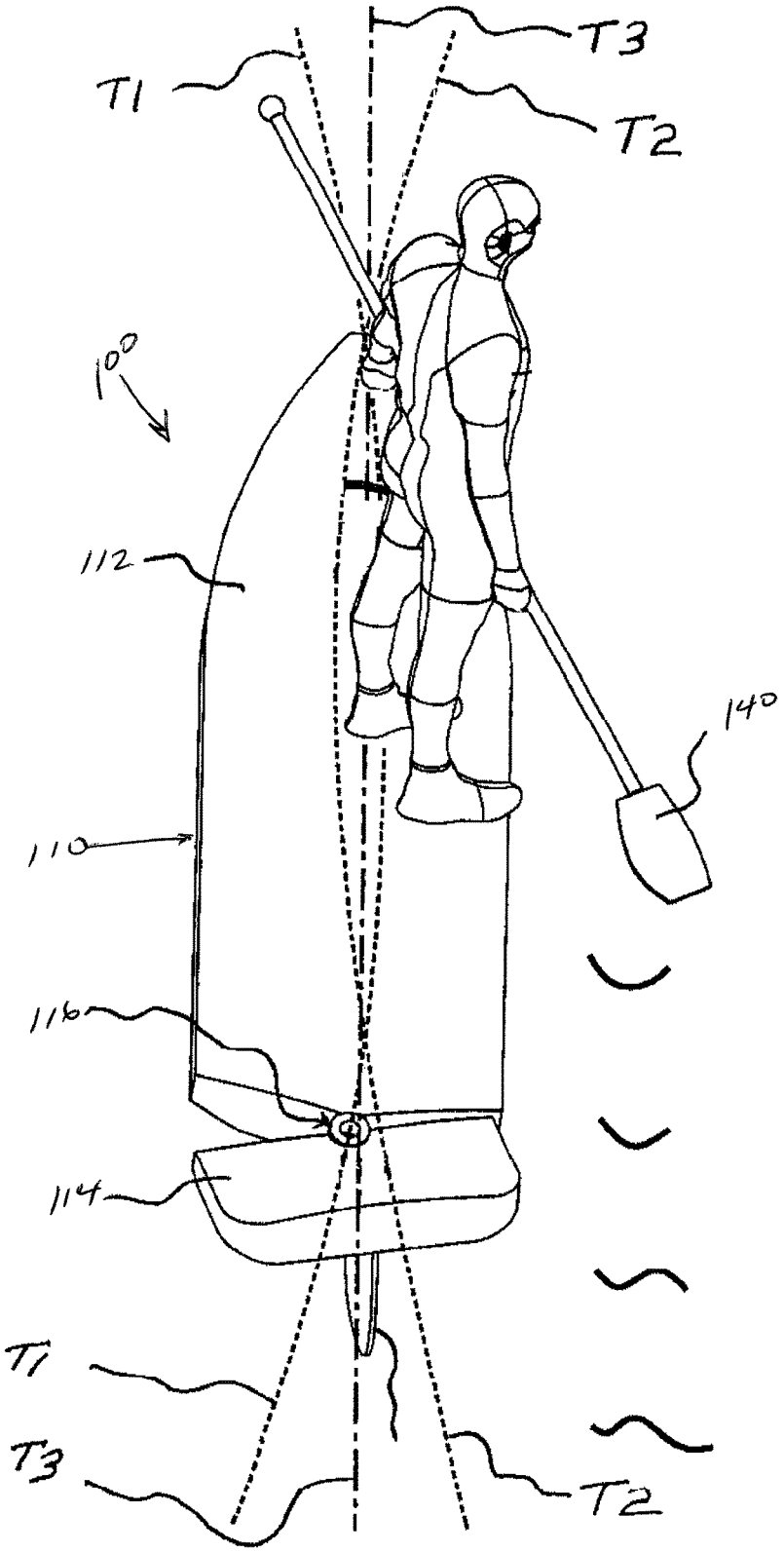
FIG. 1 is perspective view of a floatation device having a positive kingpin inclination angle.
Figure 2A:
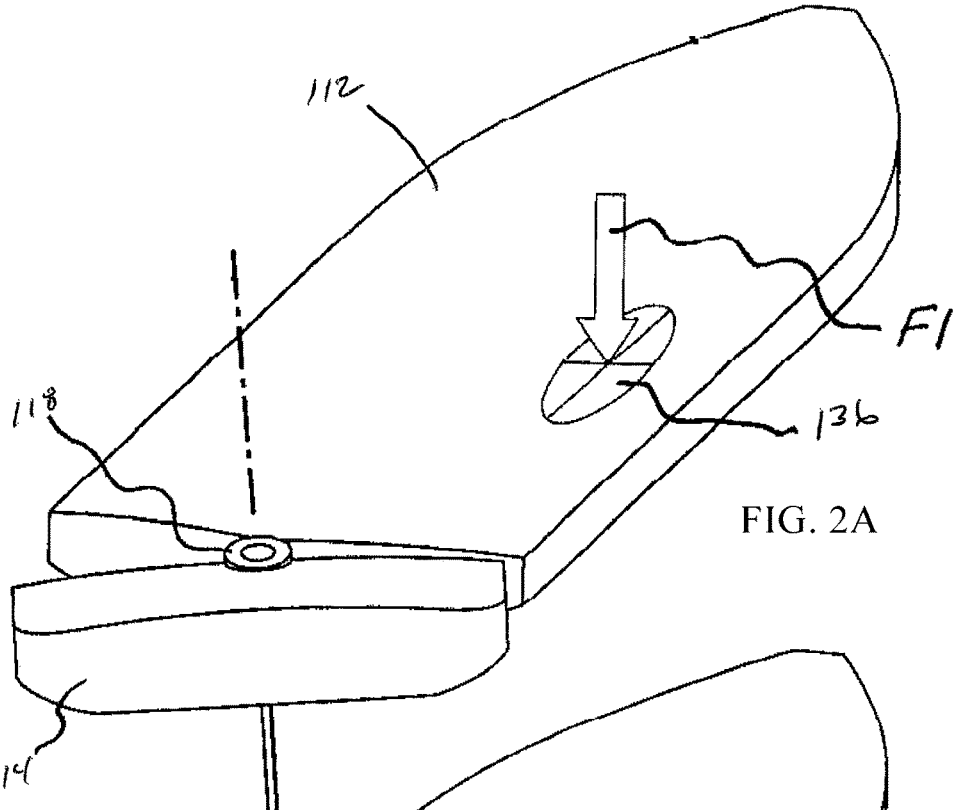
FIG. 2A is top perspective view of the floatation device shown in FIG. 1.
Figure 2B:
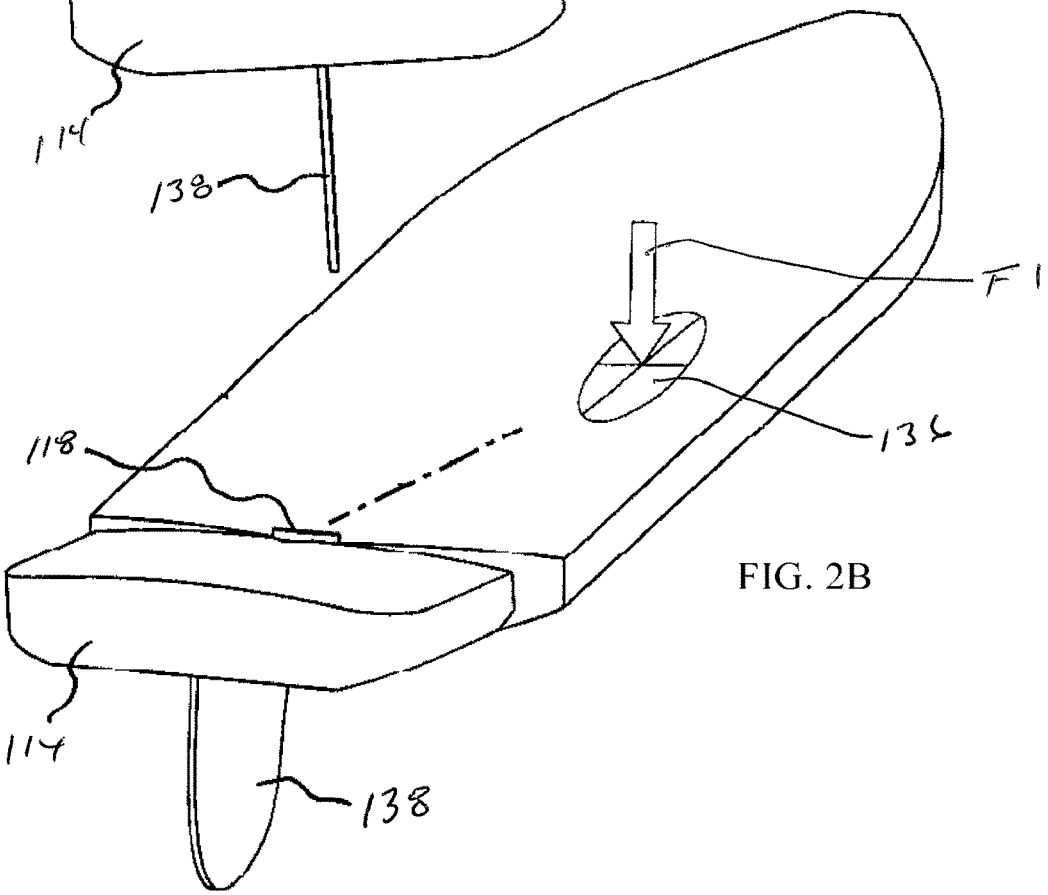
FIG. 2B is a top perspective view of a floatation device having a negative inclination angle.

Referring first to FIGS. 1-4, a floatation device is generally identified by the reference numeral 100. For purposes of illustration, but not by way of limitation, the floatation device throughout this disclosure may be generally referred to as a paddle board 110. The paddle board 110 may include a bow section 112 and a tail section 114. The tail section 114 may be pivotally connected to the bow section 112 at a kingpin assembly 116. The kingpin assembly 116 may include a substantially U-shaped or yoke-like bracket fixedly mounted to the rear end of the bow section 112 of the paddle board 110. The bracket may include upper and lower flange members 118 and 120 having respective bores 122 and 124. The flange members 118, 120 may be in a spaced apart substantially parallel relationship projecting outwardly from the rear end of the bow section 112. The flange members 118, 120 define a gap therebetween sized to receive a boss member 126 mounted to and projecting outwardly from the tail section 114 of the paddle board 110. The boss member 126 may be integrally formed, welded or otherwise fixed to a beam or a stub shaft and the like (not shown in the drawings) which may be securely fixed to the tail section 114 of the board 110. The boss member 126 may include an axial bore 128. Upon positioning the boss member 126 between the flange members 118, 120, the axial bore 128 may be aligned with the bores 122 and 124 of the flange members 118 and 120 for receiving a kingpin 130 therethrough such that the boss member 126 and the tail section 114 of the paddle board 110 may rotate relative to the kingpin 130. Kingpin assemblies of various designs and configurations are known in the art. It will therefore be understood to those skilled in the art that the configuration of the kingpin assembly 116 described herein is for illustrative purposes and is not intended to be limiting.

As will be observed, in FIGS. 1-5 the rear end of the bow member 112 and forward end of the tail member 114 are shown cut back from proximate the kingpin assembly 116 to the edges or rails of the bow member 112 and the tail member 114. A gap 132 separating the bow member 112 and tail member 114 provides sufficient separation so that the tail member 114 may freely pivot or swivel about the kingpin 130.

Figure 3A:
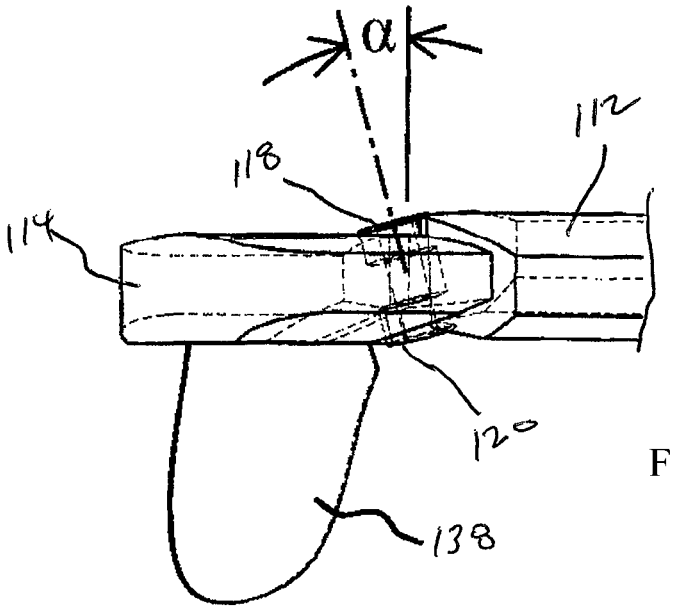
FIG. 3A is a partial side perspective view of the floatation device shown in FIG. 1 depicting a kingpin assembly in phantom.
Figure 3B:
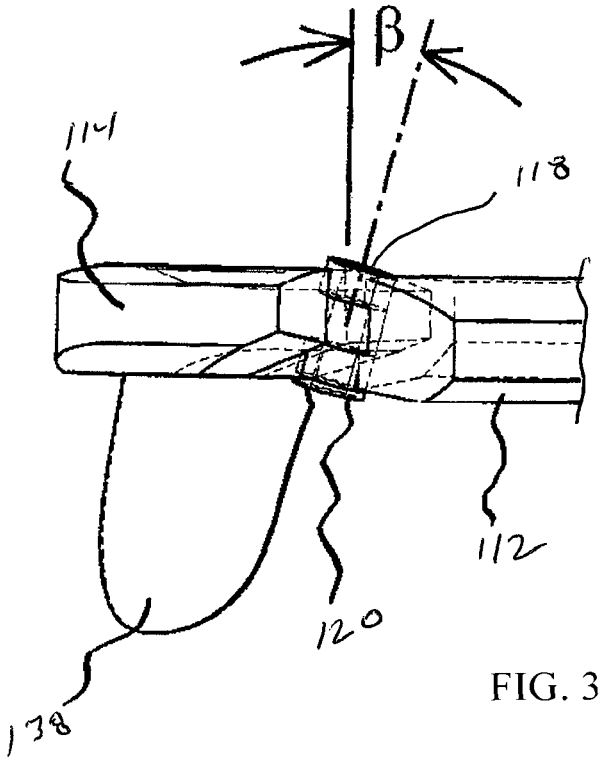
FIG. 3B is a partial side perspective view of the floatation device shown in FIG. 2B depicting a kingpin assembly in phantom.
Figure 4A:
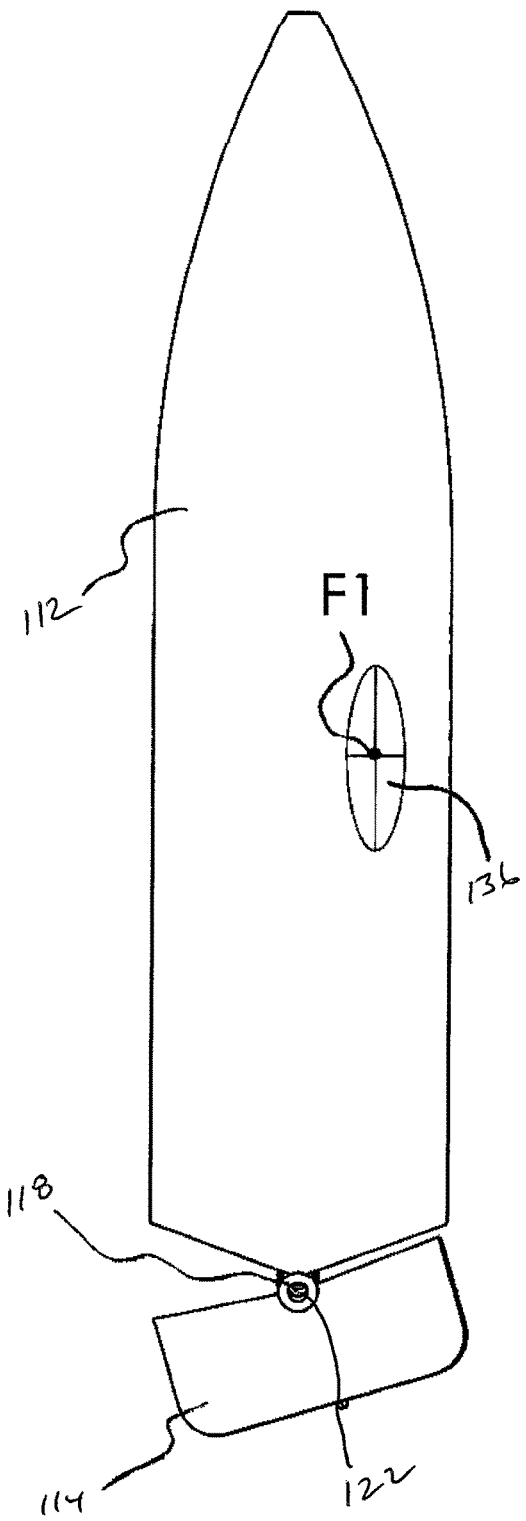
FIG. 4A is a top plan view of the floatation device shown in FIG. 1.
Figure 4B:
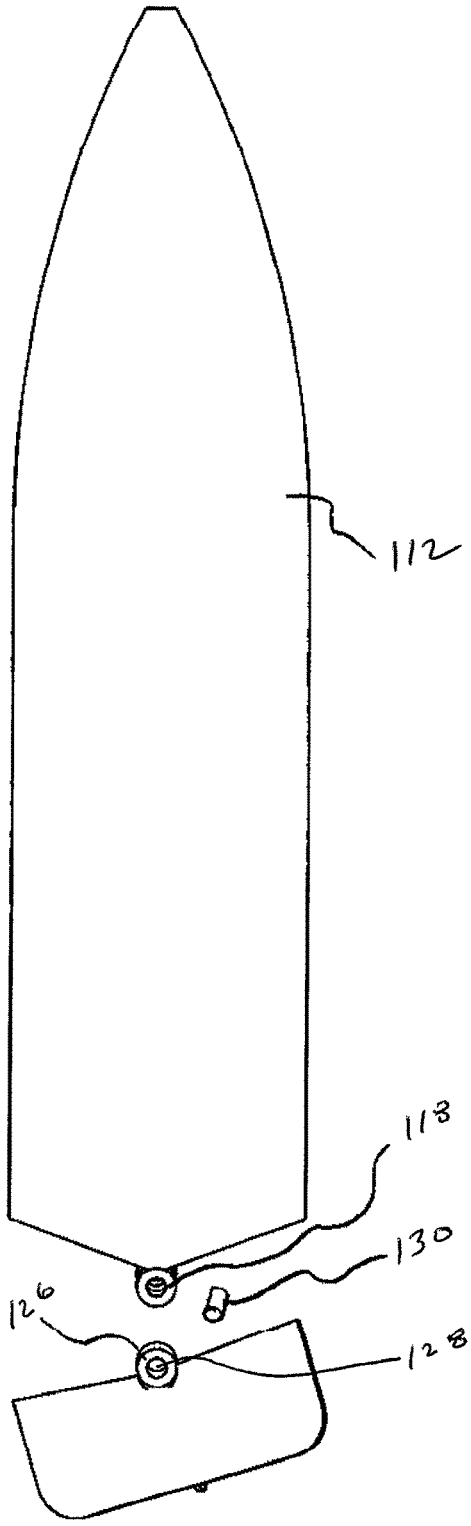
FIG. 4B is a top plan view of the floatation device shown in FIG. 4A with a tail section and kingpin assembly in exploded view.
Figure 5A:
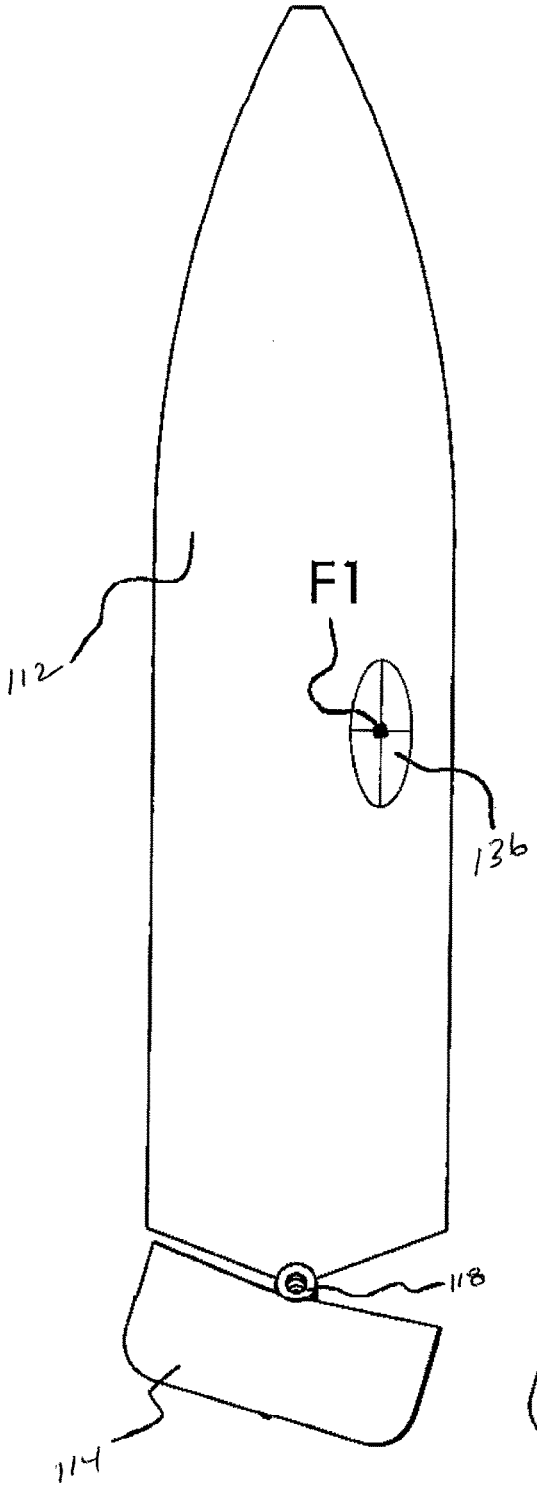
FIG. 5A is a top plan view of the floatation device shown in FIG. 2B.
Figure 5B:
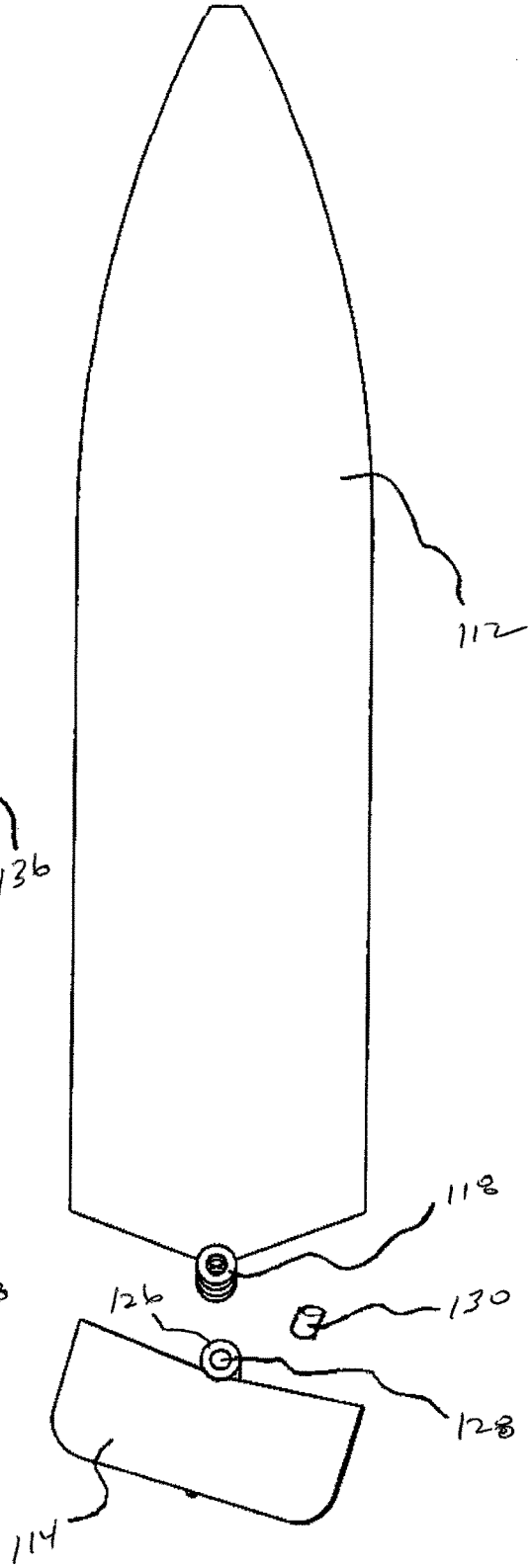
FIG. 5B is a top plan view of the floatation device shown in FIG. 5A with a tail section and kingpin assembly in exploded view.

The paddle board 110 depicted in FIG. 1 may be characterized as having a positive kingpin inclination angle (KPIA) where the kingpin axis is generally inclined downward and forward (see FIG. 3A). Briefly, a positive KPIA tends to cause the paddle board 110 to yaw in the direction that the bow section 112 of the paddle board 110 is tilted or rolled. A negative KPIA where the kingpin axis is generally inclined downward and rearward (see FIG. 3B) tends to cause the paddle board 110 to yaw in the direction that is opposite to the side of tilt or roll of the bow section 112. The inclination angle typically deviates from vertical by ten to thirty degrees (10°-30°). In most instances, the tilt or roll of the paddle board 110 may be controlled by the user. In other instances, tilt or roll may be the result of high winds moving over the paddle board 110.

Referring again to FIG. 1, tilt or roll of the paddle board 110 may be accomplished by the user standing to one side or the other of the longitudinal center axis of the bow section 112. For example, for a paddle board 110 having a positive KPIA, the weight of the user standing on a region 136 on the right side of the paddle board 110, shown in FIG. 2, applies a downward force F1 causing the right side or rail of the bow section 112 to tilt or roll downward. Buoyancy forces tend to keep the bow section 112 and tail section 114 of the paddle board 110 relatively level. When the downward force F1 causes the bow section 112 to tilt or roll, a torque force is applied at the kingpin 130 causing the tail section 114 (which is still relatively level) to rotate counter clockwise about the kingpin 130. The counter clockwise rotation of the tail section 114 orientates a rudder 138 extending downward from the bottom of the tail section 114 to an angular position relative to the longitudinal center axis of the bow member 112 thereby causing the paddle board 110 to steer to the right along a tracking arc T2. The user may simultaneously paddle with an oar 140 on the right side of the bow section 112 influencing the paddle board 110 to track to the left along a tracking arc T1 in opposition to the tracking arc T2 forces, resulting in a relatively straight line tracking course T3.

Positive KPIA and negative KPIA each have their unique advantages. Using the example of paddling a paddle board, a characteristic of a positive KPIA configuration is that the paddle board yaws toward the same side of the board that the user is standing on and paddling. As a result, the user may stand on one side or the other of the paddle board to cause board tilt, and paddle at the adjacent board side while easily maintaining a straight line course forward because the resultant combined forces due to paddling, and the biased rudder angle, causes the paddle board to track straight as discussed above. Unlike paddling a prior art board, the user may remain on one side of the paddle board without having to paddle several strokes on the right side of the board followed by several strokes on the left side of the board in order to maintain generally straight line tracking.

With a board having negative KPIA, a user may effect yaw direction by shifting weight placement on the board. However, with negative KPIA the board yaws toward the side of the board opposite the side where the user is standing and paddling. With negative KPIA, directional changes may occur more abruptly.

While preferred embodiments of the invention have been shown and described, other and further embodiments of the invention may be devised without departing from the basic scope thereof, and the scope thereof is determined by the claims which follow.

The invention claimed is:

1. A floatation device comprising:

a) an elongated bow section having a longitudinal center axis, said bow section including a forward end and a rear end;

b) a tail section pivotally connected to said rear end of said bow section, said tail section including a rudder extending downward from a bottom surface of said tail section;

c) a kingpin assembly coupling said tail section to said bow section; and d) said rear end of said bow section defining angularly extending surfaces, said surfaces extending from proximate said longitudinal center axis in opposite directions toward opposite side edges of said bow section.

2. The floatation device of claim 1 wherein said kingpin assembly includes a positive kingpin angle.

3. The floatation device of claim 1 wherein said kingpin assembly includes a negative kingpin angle.

4. A method of controlling tilt yaw of a floatation device, comprising:

a) said floatation device including a bow section and a tail section, and wherein said floatation device includes a longitudinal center axis;

b) providing a kingpin assembly pivotally connecting said tail section to a rear end of said bow section;

c) applying a downward force on said bow section at a point laterally offset from said longitudinal axis to effect tilt or roll of said bow section causing said floatation device to steer in a first tracking direction;

d) simultaneously paddling along a side of said bow section proximate to said point laterally offset from said longitudinal axis, and thereby causing said floatation device to steer in a second tracking direction opposing said first tracking direction to maintain a relatively straight line tracking course.

5. The method of claim 1 including providing a kingpin assembly having a positive kingpin angle.

6. The method of claim 1 including providing a kingpin assembly having a negative kingpin angle.

* * * * *